US007607844B2

(12) United States Patent
Takasaka et al.

(10) Patent No.: US 7,607,844 B2
(45) Date of Patent: Oct. 27, 2009

(54) IMAGE FORMING APPARATUS

(75) Inventors: Daisuke Takasaka, Higashiosaka (JP); Hiroshi Kinugawa, Ibaraki (JP); Koichi Chikumoto, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 684 days.

(21) Appl. No.: 11/217,315

(22) Filed: Sep. 2, 2005

(65) Prior Publication Data

US 2006/0048498 A1 Mar. 9, 2006

(30) Foreign Application Priority Data

Sep. 9, 2004 (JP) ..... 2004-262548

(51) Int. Cl.
*B41J 17/32* (2006.01)
*B41J 35/28* (2006.01)

(52) U.S. Cl. ..... 400/208; 400/207; 400/208.1

(58) Field of Classification Search ..... 400/207, 400/208–208.1; 347/213, 214
See application file for complete search history.

(56) References Cited

U.S. PATENT DOCUMENTS 4,700,906 A * 10/1987 Lapadakis ..... 242/538.1
6,257,780 B1 * 7/2001 Ito et al. ..... 400/208

FOREIGN PATENT DOCUMENTS

| | | | |
|---|---|---|---|
| JP | 03-126650 | U | 12/1991 |
| JP | 05-246101 | A | 9/1993 |
| JP | 07-052487 | A | 2/1995 |
| JP | 2003-089257 | A | 3/2003 |

* cited by examiner

*Primary Examiner*—Daniel J Colilla
*Assistant Examiner*—Marissa L Ferguson-Samreth
(74) *Attorney, Agent, or Firm*—Global IP Counselors, LLP

(57) ABSTRACT

The image forming apparatus includes a chassis having first and second side surfaces of the chassis; an ink sheet cartridge detachably disposed between the first and second side surfaces of the chassis; a take-up reel engaging the take-up bobbin; and a feed reel engaging the feed bobbin. The ink sheet cartridge includes a casing, a take-up bobbin and a feed bobbin disposed within the casing, first and second compression coil springs respectively coupled to circumferences of portions of the take-up bobbin and the feed bobbin so as to bias the take-up bobbin and the feed bobbin in the longitudinal direction. At least one of the take-up reel and the feed reel engages the corresponding one of the take-up bobbin and the feed bobbin without a biasing member being disposed between the first surface of the chassis and the corresponding one of the take-up bobbin and the feed bobbin.

6 Claims, 12 Drawing Sheets

PRIOR ART

IMAGE FORMING APPARATUS

BACKGROUND OF THE INVENTION

1. Field of the Invention

The present invention relates to an image forming apparatus. More specifically, the present invention relates to an image forming apparatus equipped with an ink sheet cartridge.

2. Background Information

Also, a thermal transfer printer equipped with an ink sheet cartridge is known as an example of an image forming apparatus. Such thermal transfer printer generally uses an ink cartridge, which is installed within a chassis of the thermal transfer printer with an engagement mechanism. As shown in FIGS. 14-16, the ink sheet cartridge 102 has a take-up portion 102*a*, a feed portion 102*b*, and a linking portion 102*c*. As shown in FIG. 14, a take-up bobbin 102*d* is rotatably disposed inside the take-up portion 102*a* of the ink sheet cartridge 102. A feed bobbin 102*e* is rotatably disposed inside the feed portion 102*b* of the ink sheet cartridge 102. A recess that engages an engagement mechanism is provided to the linking portion 102*c* of the ink sheet cartridge 102.

As shown in FIG. 14, the take-up bobbin 102*d* has one end portion 102*g*, another end portion 102*h*, and a shaft portion 102*i*. The feed bobbin 102*e* has one end portion 102*j*, another end portion 102*k*, and a shaft portion 102*l*. Compression coil springs 102*m* and 102*n* are attached to the end portion 102*h* of the take-up bobbin 102*d* and the end portion 102*k* of the feed bobbin 102*e*, respectively. These compression coil springs 102*m* and 102*n* bias the take-up bobbin 102*d* and the feed bobbin 102*e* in the direction of the take-up reel 103 and the feed reel 104 (the direction of arrow K2 in FIG. 14), respectively.

As shown in FIG. 11, a recess 102*p* having through grooves 102*o* is provided to the end portion 102*g* of the take-up bobbin 102*d*. A recess having three grooves just like those of the end portion 102*g* of the take-up bobbin 102*d* is provided to the end portion 102*j* of the feed bobbin 102*e*. As shown in FIG. 14, a film 102*q* is wound around the shaft portion 102*i* of the take-up bobbin 102*d* and the shaft portion 102*l* of the feed bobbin 102*e*.

As shown in FIGS. 11 and 12, the take-up reel 103 includes a metal rotary shaft 103*a*, a plastic take-up bobbin engagement portion 103*b* attached to one end of the rotary shaft 103*a*, a torque limiter 103*c* attached to the other end of the rotary shaft 103*a*, compression coil springs 103*d* and 103*e*, metal retaining snap rings 103*f* and 103*g*, and position limiting snap rings 103*h* and 103*i*. As shown in FIG. 12, this rotary shaft 103*a* is rotatably attached to the side surface of the chassis by the bearing member 106, and its movement in the axial direction is limited by the position limiting snap rings 103*h* and 103*i*.

As shown in FIG. 12, the take-up bobbin engagement portion 103*b* of the take-up reel 103 is disposed so as to protrude inward from the side surface of the chassis. This take-up bobbin engagement portion 103*b* is constituted so as to be capable of moving along the rotary shaft 103*a* in the direction of the arrow M2 in FIG. 12 against the biasing force of the compression coil spring 103*d*. As shown in FIG. 11, the take-up bobbin engagement portion 103*b* also has protruding ribs 103*j* that engage the grooves 102*o* of the end portion 102*g* of the take-up bobbin 102*d*.

As shown in FIGS. 11 and 12, the torque limiter 103*c* has a gear 103*k* that is rotated by drive force from the motor, a felt portion 103*l* in contact with the gear 103*k*, and a circular plate 103*m* to which the felt portion 103*l* is attached. The compression coil spring 103*d* is disposed between the take-up bobbin engagement portion 103*b* and the position limiting snap ring 103*h* so that the take-up bobbin engagement portion 103*b* is biased toward the take-up bobbin 102*d* of the ink sheet cartridge 102. The compression coil spring 103*e* is disposed between the plate 103*m* and the retaining snap ring 103*g* so that the plate 103*m* is biased toward the gear 103*k* via the felt portion 103*l*.

As shown in FIG. 13, the feed reel 104 includes a metal rotary shaft 104*a*, a plastic feed bobbin engagement portion 104*b* attached to one end of the rotary shaft 104*a*, a compression coil spring 104*c*, a metal retaining snap ring 104*d*, and position limiting snap rings 104*e* and 104*f*. This rotary shaft 104*a* is rotatably attached to the side surface of the chassis by the bearing member 107, and its position in the axial direction is limited by the position limiting snap rings 104*e* and 104*f*.

The feed bobbin engagement portion 104*b* of the feed reel 104 is disposed so as to protrude inward from the side surface of the chassis. This feed bobbin engagement portion 104*b* is constituted so as to be capable of moving along the rotary shaft 104*a* in the direction of the arrow M2 in FIG. 13 against the biasing force of the compression coil spring 104*c*. As shown in FIG. 14, the plastic feed bobbin engagement portion 104*b* is disposed so as to engage the end portion 102*j* of the feed bobbin 102*e*. Also, the compression coil spring 104*c* is disposed between the feed bobbin engagement portion 104*b* and the position limiting snap ring 104*e*, so that the feed bobbin engagement portion 104*b* is biased toward the feed bobbin 102*e* of the ink sheet cartridge 102.

Next, the manner in which paper is fed and the film 102*q* is taken up in a conventional thermal transfer printer will be described through reference to FIGS. 11 and 12. During the paper feed operation, the torque from the motor is not transmitted to the gear 103*k* of the torque limiter 103*c*. Therefore, the take-up reel 103 does not rotate.

On the other hand, during the paper discharge operation (that is, during printing), the torque of the motor is transmitted to the gear 103*k* of the torque limiter 103*c*. As shown in FIG. 12, at this point, the plate 103*m* of the torque limiter 103*c* is biased toward the gear 103*k* by the compression coil spring 103*e*, so the drive force transmitted to the gear 103*k* is transmitted through the felt portion 103*l* to the plate 103*m*. As a result, the gear 103*k* and the plate 103*m* rotate integrally in the direction of the arrow F2 in FIG. 11.

The take-up bobbin engagement portion 103*b* is attached to the rotary shaft 103*a* so as to rotate integrally therewith. The rotary shaft 103*a* rotates integrally with the plate 103*m* of the torque limiter 103*c*. Thus, when the drive force from the motor is transmitted to the gear 103*k* of the torque limiter 103*c*, the torque limiter 103*c* rotates in the direction of the arrow F2 in FIG. 11, whereupon the take-up bobbin engagement portion 103*b* also rotates in the direction of the arrow F2. As a result, the take-up bobbin 102*d* engaged with the take-up bobbin engagement portion 103*b* also rotates in the direction of the arrow F2, causing the film 102*q* wound around the shaft portion 102*i* of the take-up bobbin 102*d* to be taken up. Also, when the film 102*q* is taken up, the feed bobbin 102*e* around which the film 102*q* is wound also rotates, and the feed reel 104 engaged with the feed bobbin 102*e* also rotates.

In this case, when a load torque that exceeds a predetermined torque is applied to the take-up bobbin engagement portion 103*b*, the felt portion 103*l* attached to the plate 103*m* as shown in FIG. 12 slips with respect to the gear 103*k*. Thus, even when the gear 103*k* rotates, the plate 103*m* does not. Consequently, when a load torque that exceeds a specific torque is applied to the take-up bobbin engagement portion

103*b*, the torque is not transmitted to the rotary shaft 103*a*, and the rotary shaft 103*a* does not rotate.

Next, the installation and ejection of the ink sheet cartridge 102 will be described through reference to FIGS. 14 to 16. First, in the installation of the ink sheet cartridge 102, the ink sheet cartridge 102 is moved from the state shown in FIG. 14 in the direction of the arrow K2. As a result, as shown in FIG. 15, one end portion 102*g* of the take-up bobbin 102*d* and one end portion 102*j* of the feed bobbin 102*e* inside the ink sheet cartridge 102 are engaged with the take-up bobbin engagement portion 103*b* of the take-up reel 103 and the feed bobbin engagement portion 104*b* of the feed reel 104, respectively.

Then, the take-up bobbin engagement portion 103*b* of the take-up reel 103 and the feed bobbin engagement portion 104*b* of the feed reel 104 are moved by the distance L2 (ejection stroke) in the direction of the arrow M2 shown in FIG. 15 against the biasing force of the compression coil springs 103*d* and 104*c*. Accordingly, the compression coil springs 103*d* and 104*c* are compressed by the amount L2. Then, the installation of the ink sheet cartridge 102 is completed by engaging an engagement portion of the engagement mechanism with the recess 102*f* of the linking portion 102*c* of the ink sheet cartridge 102.

In this installed state, the take-up bobbin 102*d* and the feed bobbin 102*e* are respectively biased toward the take-up reel 103 and the feed reel 104 (the direction of the arrow M2 in FIG. 15) by the compression coil spring 102*m* attached to the end portion 102*h* of the take-up bobbin 102*d* and the compression coil spring 102*n* attached to the end portion 102*k* of the feed bobbin 102*e*. Accordingly, the take-up bobbin 102*d* and the feed bobbin 102*e* are securely engaged with the take-up reel 103 and the feed reel 104, respectively.

Next, ejection of the ink sheet cartridge 102 is performed by disengaging the ink sheet cartridge from the engagement mechanism. As a result, the compression coil springs 103*d* and 104*c* of the take-up reel 103 and the feed reel 104 try to expand by the amount they were compressed (the ejection stroke L2 shown in FIG. 15). Accordingly, an ejection force is applied in the direction of the arrow N2 shown in FIG. 17 to the ink sheet cartridge 102. As a result, as shown in FIG. 16, the ink sheet cartridge 102 is moved in the eject direction by the ejection stroke L2 in FIG. 15 from the chassis.

With the conventional thermal transfer printer shown in FIGS. 11-16, the ejection force and ejection stroke (L2 in FIG. 15) at the time of ejection of the ink sheet cartridge 102 is obtained by compressing the compression coil spring 103*d* of the take-up reel 103 and the compression coil spring 104*c* of the feed reel 104. Also, the take-up bobbin 102*d* and the feed bobbin 102*e* are securely engaged with the take-up reel 103 and the feed reel 104 with the compression coil springs 102*m* and 102*n*, which are respectively attached to the end portions 102*h* and 102*k* of the take-up bobbin 102*d* inside the ink sheet cartridge 102. In other words, in the conventional thermal transfer printer shown in FIGS. 11-16, the compression coil spring 103*d* of the take-up reel 103 and the compression coil spring 104*c* of the feed reel 104, which are used to eject the ink sheet cartridge 102, are provided separately from the compression coil springs 102*m* and 102*n*, which are used to securely engage the take-up bobbin 102*d* and the feed bobbin 102*e* with the take-up reel 103 and the feed reel 104. Such construction requires a large number of parts.

In view of the above, it will be apparent to those skilled in the art from this disclosure that there exists a need for an improved thermal transfer printer that overcomes the problems of the present invention. This invention addresses this need in the art as well as other needs, which will become apparent to those skilled in the art from this disclosure.

SUMMARY OF THE INVENTION

It is an object of this invention to provide an image forming apparatus in which an ink sheet cartridge can be securely ejected and installed, without having to use a large number of parts.

The image forming apparatus in accordance with a first aspect of the present invention includes a chassis having first and second side surfaces; an ink sheet cartridge configured to be detachably disposed between the first and second side surfaces of the chassis; a take-up reel rotatably supported by the first side surface of the chassis; a feed reel rotatably supported by the first side surface of the chassis. The ink sheet cartridge includes a casing, a take-up bobbin disposed within the casing, a feed bobbin disposed within the casing, a film being configured to be wound around the take-up bobbin and the feed bobbin, a first compression coil spring coupled to a circumference of a portion of the take-up bobbin so as to bias the take-up bobbin in the longitudinal direction, and a second compression coil spring coupled to a circumference of a portion of the feed bobbin so as to bias the feed bobbin in the longitudinal direction. The take-up reel is configured to engage the take-up bobbin. The feed reel is configured to engage the feed bobbin. At least one of the take-up reel and the feed reel being configured to engage the corresponding one of the take-up bobbin and the feed bobbin without a biasing member being disposed between the first surface of the chassis and the corresponding one of the take-up bobbin and the feed bobbin.

In the image forming apparatus in accordance with the second aspect of this invention, both of the take-up reel and the feed reel are configured to engage the corresponding one of the take-up bobbin and the feed bobbin without a biasing member being disposed between the first surface of the chassis and the corresponding one of the take-up bobbin and the feed bobbin.

In the image forming apparatus in accordance with the third aspect of this invention, the take-up reel is configured to engage the take-up bobbin with a third compression coil spring being disposed between the first surface of the chassis and the take-up bobbin, the third compression coil spring being coupled to a circumference of a portion of the take-up reel, and the feed reel is configured to engage the feed bobbin without a biasing member being disposed between the first surface of the chassis and the feed bobbin.

The image forming apparatus in accordance with the fourth aspect of this invention further includes a latching member attached to the second surface of the chassis and configured to engage the ink sheet cartridge for fixedly installing the ink sheet cartridge between the first and second surfaces of the chassis.

In the image forming apparatus in accordance with the fifth aspect of this invention, the take-up bobbin is a one-piece unitary member, the first compression coil being coupled to a circumference of an end portion of the take-up bobbin, and the feed bobbin is a one-piece unitary member, the second compression coil being coupled to a circumference of an end portion of the feed bobbin.

With this constitution, when the ink sheet cartridge is installed, the ink sheet cartridge can be prevented from being ejected even though the first compression coil spring and the second compression coil spring attached to the take-up bobbin and the feed bobbin inside the ink sheet cartridge are pressed and compressed.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Specific embodiments of the present invention will now be described through reference to the drawings.

Figure 1:
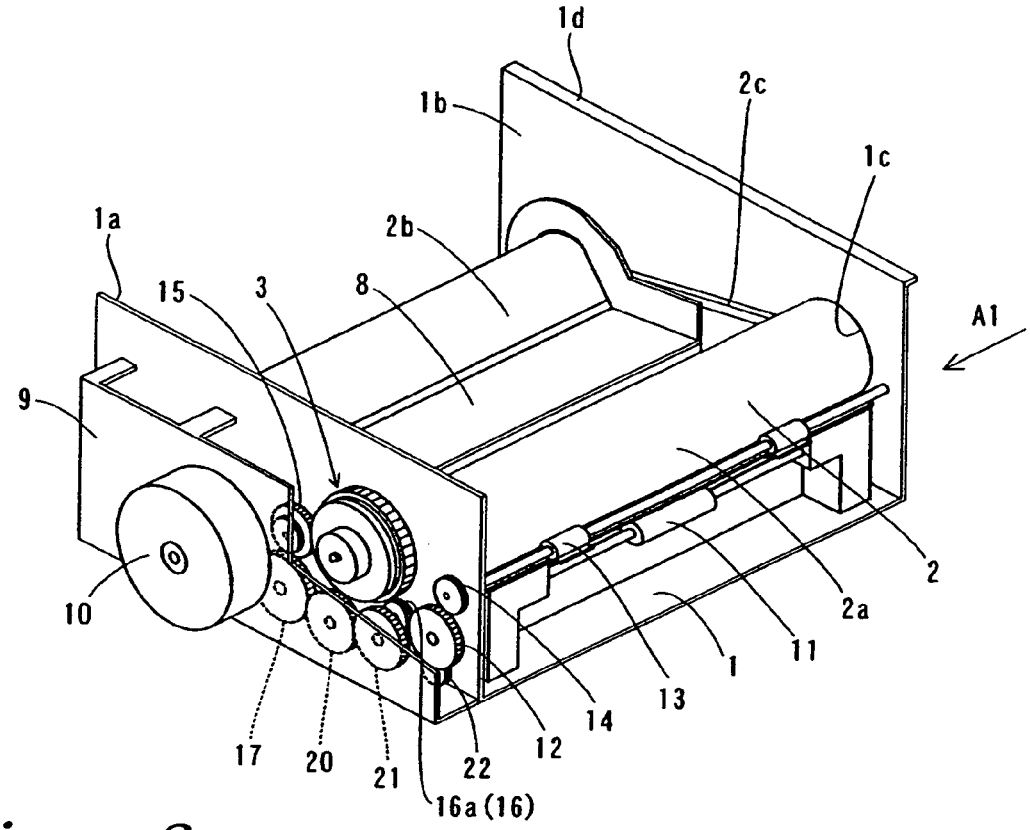
FIG. 1 is a perspective view of the overall structure of a thermal transfer printer pertaining to a first embodiment of the present invention.
Figure 2:
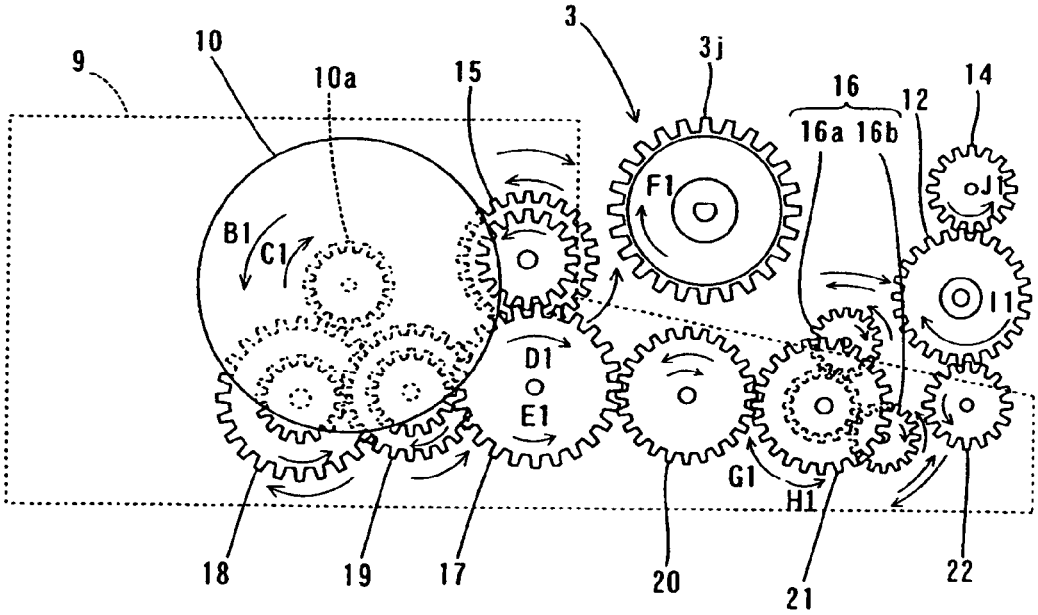
FIG. 2 is a side view of the motor and gears of the thermal transfer printer pertaining to the first embodiment shown in FIG. 1.
Figure 3:
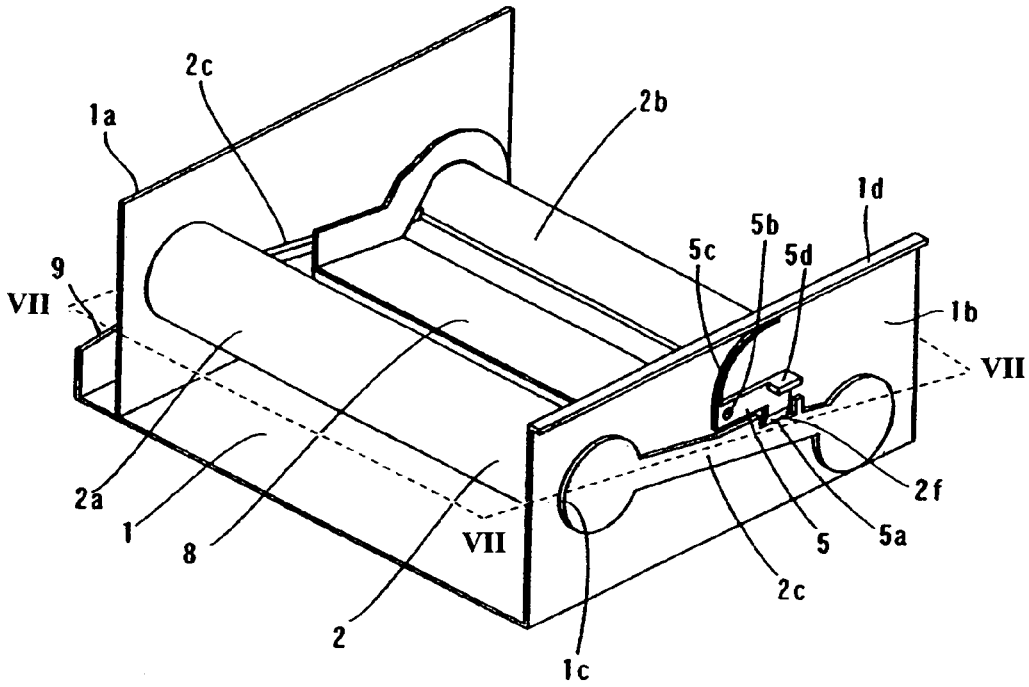
FIG. 3 is a perspective view of the chassis and the ink sheet cartridge of the thermal transfer printer pertaining to the first embodiment shown in FIG. 1, as seen in the direction of the arrow A1.

FIGS. 1 and 3 are oblique views of the overall structure of a thermal transfer printer pertaining to an embodiment of the present invention. FIG. 2 is a front view of the motor and gears of the thermal transfer printer pertaining to an embodiment of the present invention. FIGS. 4 to 9 are diagrams illustrating the detailed structures of the take-up reel, feed reel, and ink sheet cartridge of the thermal transfer printer pertaining to an embodiment of the present invention.

The structure of the thermal transfer printer pertaining to an embodiment of the present invention will be described through reference to FIGS. 1 to 9. In this embodiment, a thermal transfer printer will be described an example of an image forming apparatus to which the present invention is applied.

As shown in FIGS. 1 to 6 and 8, the thermal transfer printer pertaining to an embodiment of the present invention includes a metal chassis 1, an ink sheet cartridge 2, a take-up reel 3, a feed reel 4 (see FIGS. 6 and 8), a latching member 5 for securing the ink sheet cartridge 2 inside the chassis 1 (see FIG. 3), bearing members 6 and 7 (see FIGS. 5 and 6), a thermal head 8 for performing printing, a motor bracket 9, a motor 10, a rubber paper feed roller 11, a paper feed roller gear 12, rubber paper discharge rollers 13, a paper discharge roller gear 14, a pivotable pivot gear 15, a pivot gear portion 16 linking pivot gears 16*a* and 16*b*, a feed roller gear 17, and a plurality of intermediate gears 18 to 22.

As shown in FIGS. 1 and 3, the chassis 1 has one side surface 1*a* and another side surface 1*b*. The motor bracket 9 is attached to the side surface 1*a* of the chassis 1. An insertion hole 1*c*, through which the ink sheet cartridge 2 is to be inserted, and a bent portion 1*d* are provided to the side surface 1*b* of the chassis 1.

Also, as shown in FIGS. 1 and 3, the ink sheet cartridge 2 has a casing that includes a take-up portion 2*a*, a feed portion 2*b*, and a linking portion 2*c*, a take-up bobbin 2*d* that is a one-piece unitary member accommodated within the take-up portion 2*a*, and a feed bobbin 2*e* that is a one-piece unitary member accommodated in the feed portion 2*b*. The take-up bobbin 2*d* and the feed bobbin 2*e* are supported within the casing via compression coil springs 2*m* and 2*n*, respectively, so as to be movable in the longitudinal direction due to the biasing force of the compression coil springs 2*m* and 2*n*.

Figure 7:
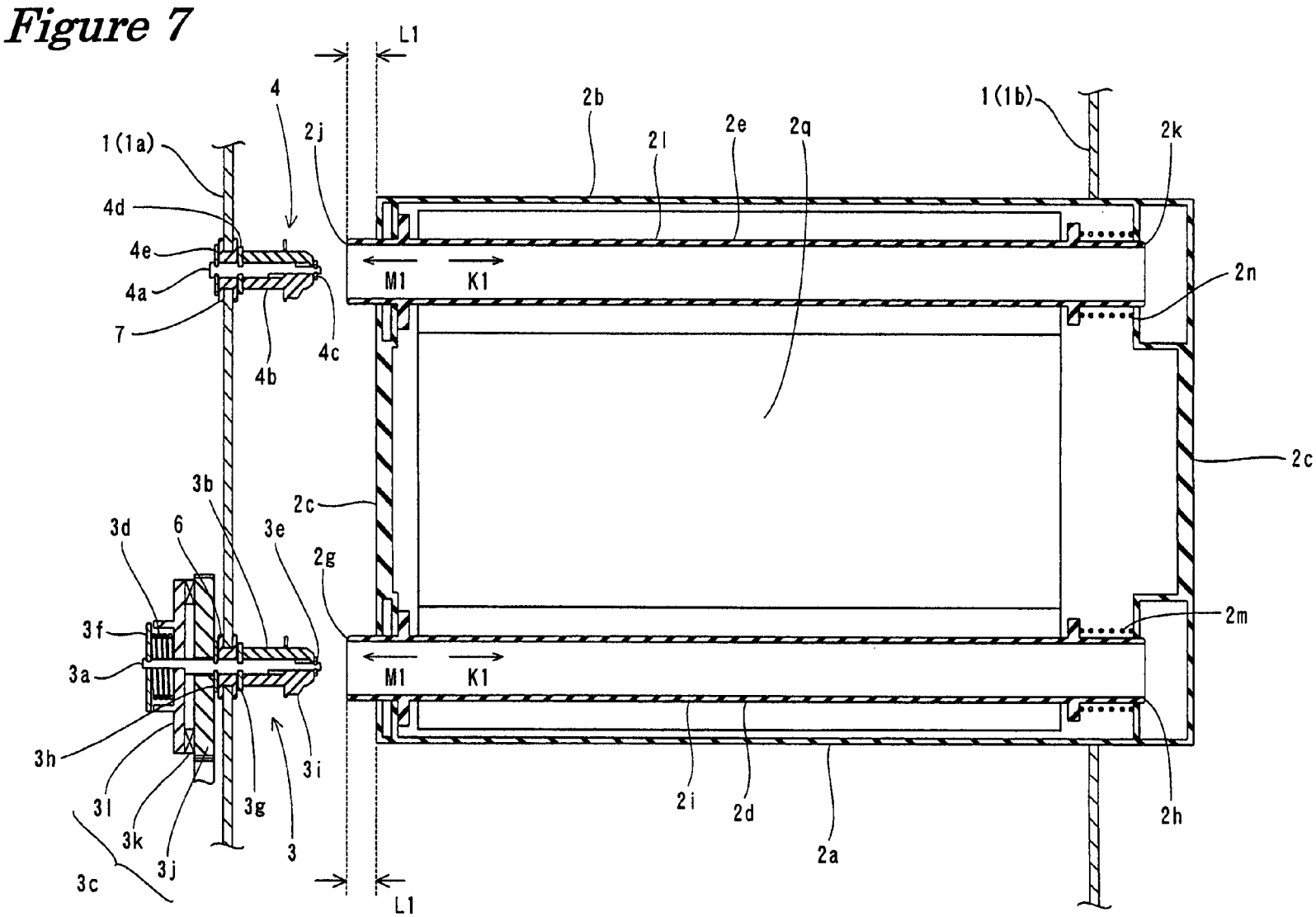
FIG. 7 is a cross sectional view of the thermal transfer printer pertaining to the first embodiment shown in FIG. 1 as viewed from above at the section VII-VII shown in FIG. 2, before the installation of the ink sheet cartridge.

In this embodiment, as shown in FIG. 7, a take-up bobbin 2*d* is rotatably disposed inside the take-up portion 2*a* of the ink sheet cartridge 2 so as to be capable of moving by an ejection stroke amount (L1) in the direction of the arrow K1. Similarly, a feed bobbin 2*e* is rotatably disposed inside the feed portion 2*b* of the ink sheet cartridge 2 so as to be capable of moving by an ejection stroke amount (L1) in the direction of the arrow K1.

As shown in FIG. 3, a recess 2*f* that engages with an engagement portion 5*a* of the latching member 5 is provided to the linking portion 2*c* of the ink sheet cartridge 102. As shown in FIG. 7, the take-up bobbin 2*d* has one end portion 2*g*, another end portion 2*h*, and a shaft portion 2*i*. Similarly, the feed bobbin 2*e* has one end portion 2*j*, another end portion 2*k*, and a shaft portion 2*l*. The end portions 2*g* and 2*j* of the take-up bobbin 2*d* and the feed bobbin 2*e* protrude from the linking portion 2*c* by an ejection stroke amount (L1) in the direction toward the side surface 1*a* of the chassis 1 (in the direction of the arrow M1).

Compression coil springs 2*m* and 2*n* are attached to the end portions 2*h* and 2*k* of the take-up bobbin 2*d* and the feed bobbin 2*e*, respectively, in this embodiment. The function of these compression coil springs 2*m* and 2*n* is to bias the take-up bobbin 2*d* and the feed bobbin 2*e* in the direction of the take-up reel 3 and the feed reel 4 (in the direction of the arrow M1 in FIG. 7), respectively. Another function of the compression coil springs 2*m* and 2*n* is to generate a force for moving the ink sheet cartridge 2 by an ejection stroke amount (L1 in FIG. 8) in the eject direction (in the direction of the arrow O1 in FIG. 8) during the ejection of the ink sheet cartridge 2.

Figure 4:
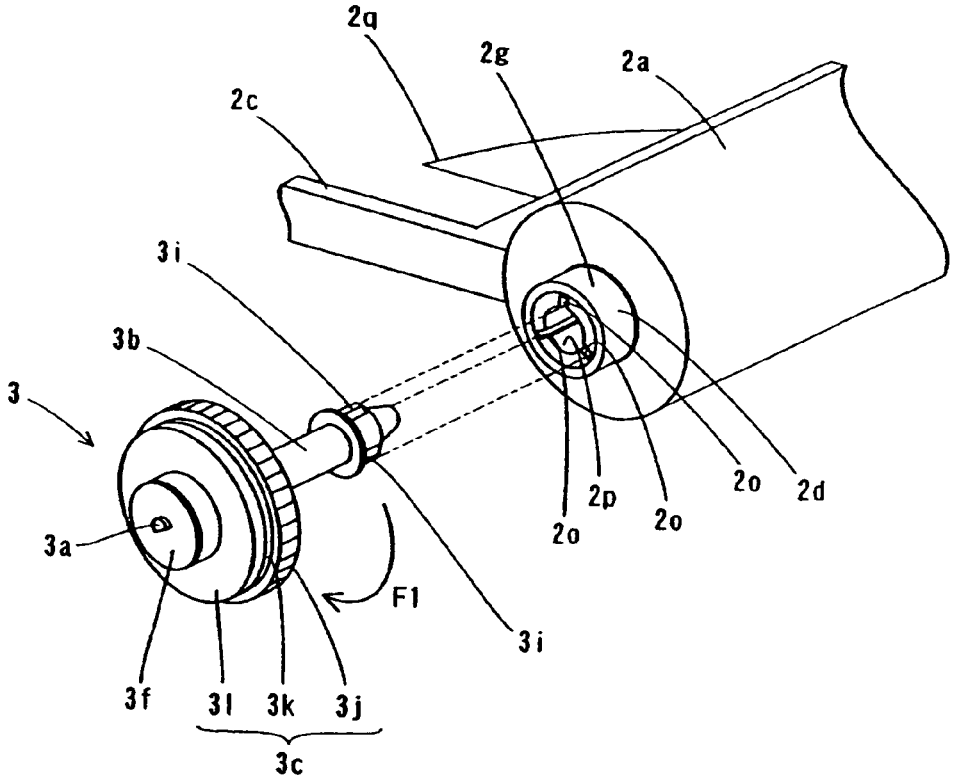
FIG. 4 is an exploded perspective view of the take-up reel and the ink sheet cartridge of the thermal transfer printer pertaining to the first embodiment shown in FIG. 1.

As shown in FIG. 4, a recess 2*p* having three grooves 2*o* is provided to the end portion 2*g* of the take-up bobbin 2*d*. A recess (not shown) having three grooves just like those of the end portion 2*g* of the take-up bobbin 2*d* is provided to the end portion 2*j* of the feed bobbin 2*e*. As shown in FIG. 7, a film 2*q* is wound around the shaft portion 2*i* of the take-up bobbin 2*d* and the shaft portion 2*l* of the feed bobbin 2*e*.

Figure 5:
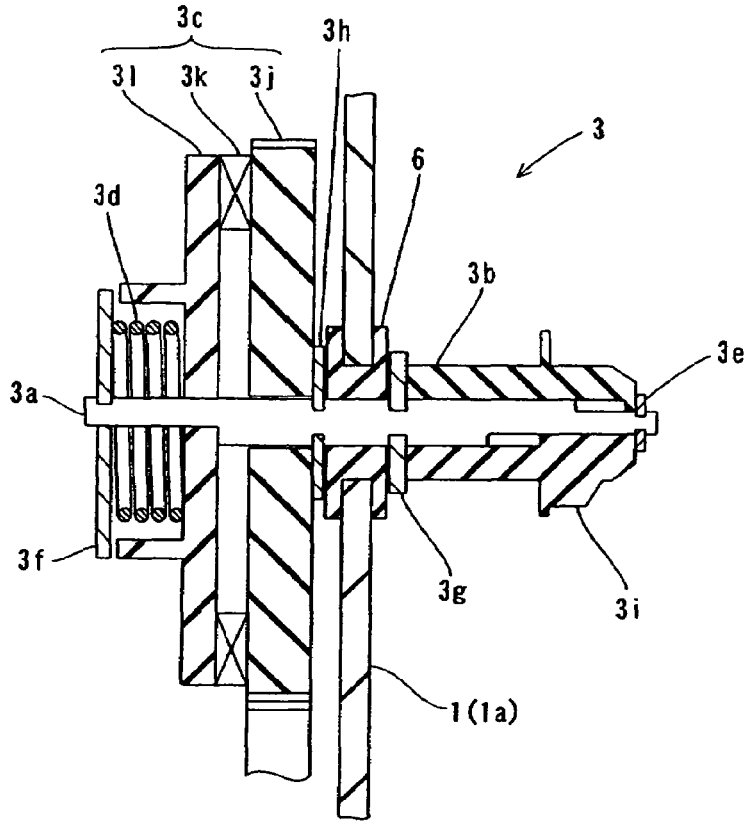
FIG. 5 is a partial cross sectional view of the take-up reel of the thermal transfer printer pertaining to the first embodiment shown in FIG. 1, as viewed from above at the section VII-VII shown in FIG. 2.

As shown in FIGS. 4 and 5, the take-up reel 3 includes a metal rotary shaft 3*a*, a plastic take-up bobbin engagement portion 3*b* attached to one end of the rotary shaft 3*a*, a torque limiter 3*c* attached to the other end of the rotary shaft 3*a*, a compression coil spring 3*d*, metal retaining snap rings 3*e* and 3*f*, and position limiting snap rings 3*g* and 3*h*. As shown in FIG. 5, this rotary shaft 3*a* is rotatably attached to the side surface 1*a* of the chassis 1 by the bearing member 6, and its movement in the axial direction is limited by the position limiting snap rings 3*g* and 3*h*.

In this embodiment, no compression coil spring is disposed between the take-up bobbin engagement portion 3*b* and the position limiting snap ring 3*g*, and the take-up bobbin engagement portion 3*b* instead extends all the way to the position limiting snap ring 3*g*. Also, as shown in FIG. 4, the plastic take-up bobbin engagement portion 3*b* has protruding ribs 3*i* that engage with the grooves 2*o* of the end portion 2*g* of the take-up bobbin 2*d*. As shown in FIGS. 4 and 5, the torque limiter 3*c* has a gear 3*j* that is rotated by drive force from the motor 10 (see FIG. 1), a felt portion 3*k* that is in contact with the gear 3*j*, and a circular plate 3*l* to which the felt portion 3*k* is attached. The compression coil spring 3*d* is disposed between the plate 3*l* and the retaining snap ring 3*f* so as to bias the plate 3*l* toward the gear 3*j* via the felt portion 3*k*.

Figure 6:
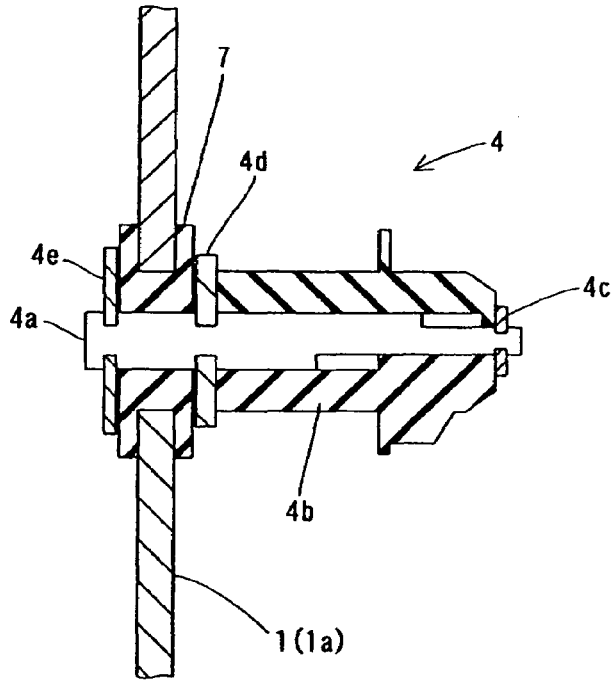
FIG. 6 is a partial cross sectional view of the feed reel of the thermal transfer printer pertaining to the first embodiment shown in FIG. 1, as viewed from above at the section VII-VII shown in FIG. 2.

As shown in FIG. 6, the feed reel 4 includes a metal rotary shaft 4*a*, a plastic feed bobbin engagement portion 4*b* attached to one end of the rotary shaft 4*a*, a metal-made retaining snap ring 4*c*, and position limiting snap rings 4*d* and 4*e*. This rotary shaft 4*a* is rotatably attached to the side surface 1*a* of the chassis 1 by the bearing member 7, and its movement in the axial direction is limited by the position limiting snap rings 4*d* and 4*e*.

In this embodiment, no compression coil spring is disposed between the feed bobbin engagement portion 4*b* and the position limiting snap ring 4*d*, and the feed bobbin engagement portion 4*b* is formed so as to extend all the way to the position limiting snap ring 4*d*. As shown in FIG. 7, the plastic feed bobbin engagement portion 4*b* is disposed so as to engage the end portion 2*j* of the feed bobbin 2*e*.

As shown in FIG. 3, the latching member 5 has the engagement portion 5*a*, a support portion 5*b*, a leaf spring 5*c*, and a grasping portion 5*d*. This support portion 5*b* is attached to the side surface 1*b* of the chassis 1, and pivotably supports the latching member 5. The leaf spring 5*c* abuts on the bent portion 1*d* of the side surface 1*b* of the chassis 1, and biases the latching member 5 downward. The grasping portion 5*d* is raised upward against the biasing force of the leaf spring 5*c* to disengage the engagement portion 5*a* from the recess 2*f* of the ink sheet cartridge 2.

As shown in FIGS. 1 and 3, the thermal head 8 used for printing is attached rotatably around a support shaft on the inside of the side surface 1*a* and the side surface 1*b* of the chassis 1. Also, as shown in FIG. 2, a motor gear 10*a* is attached to the shaft of the motor 10 attached to the motor bracket 9. The motor 10 functions as the drive source for driving the gear 3*j* of the torque limiter 3*c* of the take-up reel 3, the paper feed roller gear 12, the paper discharge roller gear 14, and the feed roller gear 17.

Next, how paper is fed and how the film 2*q* is taken up with the thermal transfer printer pertaining to an embodiment of the present invention will be described through reference to FIGS. 2, 4, and 5. During paper feed operation, first, as shown in FIG. 2, the drive of the motor 10 rotates the motor gear 10*a* attached to the motor 10 in the direction of the arrow C1, and rotates the feed roller gear 17 in the direction of the arrow E1 via the intermediate gears 18 and 19. As a result, a feed roller (not shown) rotates in the direction of the arrow E1. At this point, the pivotable pivot gear 15 is not meshed with the gear 3*j* of the torque limiter 3*c* of the take-up reel 3, and therefore the gear 3*j* of the torque limiter 3*c* of the take-up reel 3 does not rotate. As a result, the film 2*q* wound around the shaft portion 2*i* of the take-up bobbin 2*d* and the shaft portion 2*l* of the feed bobbin 2*e* is not taken up during the paper feed operation.

When the feed roller gear 17 rotates in the direction of the arrow E1, the intermediate gear 21 rotates in the direction of the arrow H1 via the intermediate gear 20. At this point, the pivot gear 16*b* of the pivotable pivot gear portion 16 meshes with the intermediate gear 22. Therefore, the rotation of the intermediate gear 21 in the direction of the arrow H1 causes the paper feed roller gear 12 to rotate in the direction of the arrow 11 via the intermediate gear 22 and the pivot gear 16*b* of the pivot gear portion 16. As a result, paper is conveyed by the paper feed roller 11 in the paper feed direction, and the paper is fed to the thermal head 8 by the feed roller that is rotating in the direction of the arrow E1.

Also, as shown in FIG. 2, during the paper discharge operation (that is, during printing), the motor gear 10*a* attached to the motor 10 rotates in the direction of the arrow B1 along with the drive from the motor 10, and the feed roller gear 17 rotates in the direction of the arrow D1 via the intermediate gears 18 and 19. At this point, the pivotable pivot gear 15 engages with the gear 3*j* of the torque limiter 3*c* of the take-up reel 3, and rotates the gear 3*j* of the torque limiter 3*c* of the take-up reel 3 in the direction of the arrow F1. At this point, the plate 3*l* of the torque limiter 3*c* is biased toward the gear 3*j* by the compression coil spring 3*d* as shown in FIG. 4. Therefore, the drive force transmitted to the gear 3*j* is transmitted through the felt portion 3*k* to the plate 3*l*. As a result, the gear 3*j* and the plate 3*l* rotate integrally in the direction of the arrow F1 shown in FIGS. 2 and 4.

Also, the take-up bobbin engagement portion 3*b* is attached to the rotary shaft 3*a* and rotates integrally with the rotary shaft 3*a*, and the rotary shaft 3*a* rotates integrally with the plate 3*l* of the torque limiter 3*c*. Thus, when the drive force from the motor 10 is transmitted to the gear 3*j* of the torque limiter 3*c*, the torque limiter 3*c* rotates in the direction of the arrow F1, whereupon the take-up bobbin engagement portion 3*b* also rotates in the direction of the arrow F1. As a result, the take-up bobbin 2*d* engaged with the take-up bobbin engagement portion 3*b* also rotates in the direction of the arrow F1, causing the film 2*q* wound around the shaft portion 2*i* of the take-up bobbin 2*d* to be taken up.

Also, when the film 2*q* wound around the take-up bobbin 2*d* is taken up, the feed bobbin 2*e* around which the film 2*q* is wound also rotates, and the feed reel 4 engaged with the feed bobbin 2*e* also rotates. In this case, when a load torque that equals to or exceeds a specific torque is applied to the take-up bobbin engagement portion 3*b*, the felt portion 3*k* attached to the plate 3*l* as shown in FIG. 5 slips with respect to the gear 3*j*. Thus, even though the gear 3*j* rotates, the plate 3*l* does not. Consequently, when a load torque of at least the specific torque is applied to the take-up bobbin engagement portion 3*b*, the torque is not transmitted to the rotary shaft 3*a*, and the rotary shaft 3*a* does not rotate.

Also, since the rotation of the feed roller gear 17 in the direction of the arrow D1 as shown in FIG. 2 causes the feed roller (not shown) to rotate in the direction of the arrow D1, paper is conveyed in the paper eject direction in synchronization with the take-up of the film 2*q* by the take-up bobbin 2*d*. Also, the rotation of the feed roller gear 17 in the direction of the arrow D1 causes the intermediate gear 21 to rotate in the direction of the arrow G1 via the intermediate gear 20. At this point, the pivot gear 16*a* of the pivotable pivot gear portion 16 is meshed with the paper feed roller gear 12. Therefore, the rotation of the intermediate gear 21 in the direction of the arrow G1 causes the paper feed roller gear 12 to rotate in the direction of the arrow I1 via the pivot gear 16*a* of the pivot gear portion 16, and causes the paper discharge roller gear 14 to rotate in the direction of the arrow J1. As a result, paper is conveyed in the paper eject direction by the paper discharge rollers 13.

Figure 8:
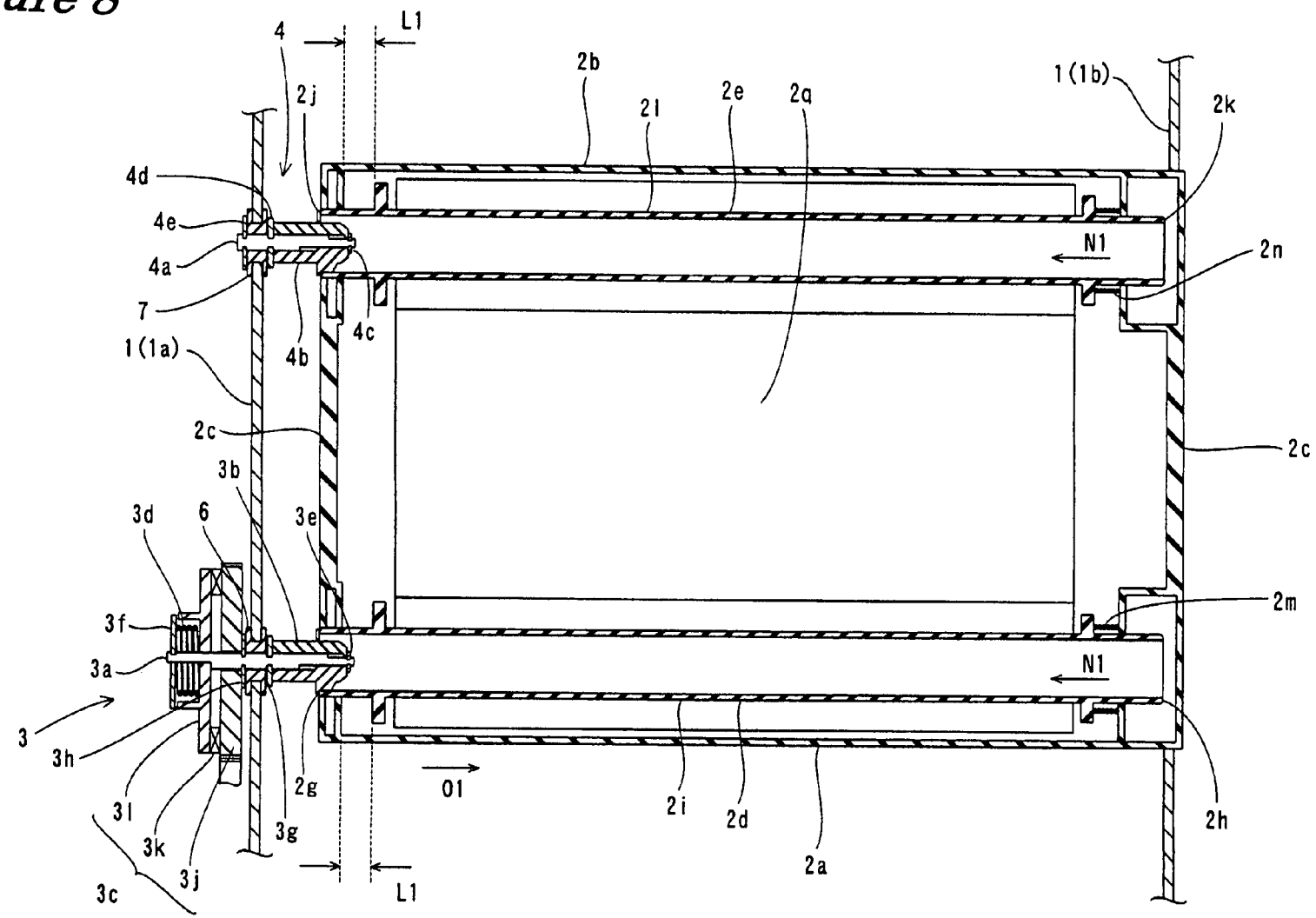
FIG. 8 is a cross sectional view of thermal transfer printer pertaining to the first embodiment shown in FIG. 1 as viewed from above at the section VII-VII shown in FIG. 2, after the installation of the ink sheet cartridge.

Next, the installation and ejection of the ink sheet cartridge 2 will be described through reference to FIGS. 3 and 7 to 9. First, in the installation of the ink sheet cartridge 2, the ink sheet cartridge 2 is moved from the state shown in FIG. 7 in the direction of the arrow M1. As a result, as shown in FIG. 8, one end portion 2*g* of the take-up bobbin 2*d* and one end portion 2*j* of the feed bobbin 2*e* of the ink sheet cartridge 2 are engaged with the take-up bobbin engagement portion 3*b* of the take-up reel 3 and the feed bobbin engagement portion 4*b* of the feed reel 4, respectively.

Here, as shown in FIG. 3, the ink sheet cartridge 2 is fixedly secured in its installed state and the installation of the ink sheet cartridge 2 is completed by engaging the engagement portion 5*a* of the latching member 5 with the recess 2*f* of the linking portion 2*c* of the ink sheet cartridge 2. In this installed state, the end portion 2*g* of the take-up bobbin 2*d* and the end portion 2*j* of the feed bobbin 2*e* are pressed on by the take-up bobbin engagement portion 3*b* of the take-up reel 3 and the feed bobbin engagement portion 4*b* of the feed reel 4. As a result, the take-up bobbin 2*d* and the feed bobbin 2*e* are moved by the ejection stroke (L1 in FIG. 8) in the direction of the arrow O1, against the biasing force of the compression coil springs 2*m* and 2*n*. Accordingly, the compression coil spring 2*m* attached to the take-up bobbin 2*d* and the compression coil spring 2*n* attached to the end portion 2*k* are both compressed by the ejection stroke amount (L1).

Also at this point, the take-up bobbin 2*d* and the feed bobbin 2*e* are biased toward the take-up reel 3 and the feed reel 4 in the direction of the arrow N1 by the compression coil spring 2*m* attached to the end portion 2*h* of the take-up bobbin 2*d* and the compression coil spring 2*n* attached to the end portion 2*k* of the feed bobbin 2*e*, respectively. Therefore, the take-up bobbin 2*d* and the feed bobbin 2*e* are securely engaged with the take-up reel 3 and the feed reel 4, respectively.

Figure 9:
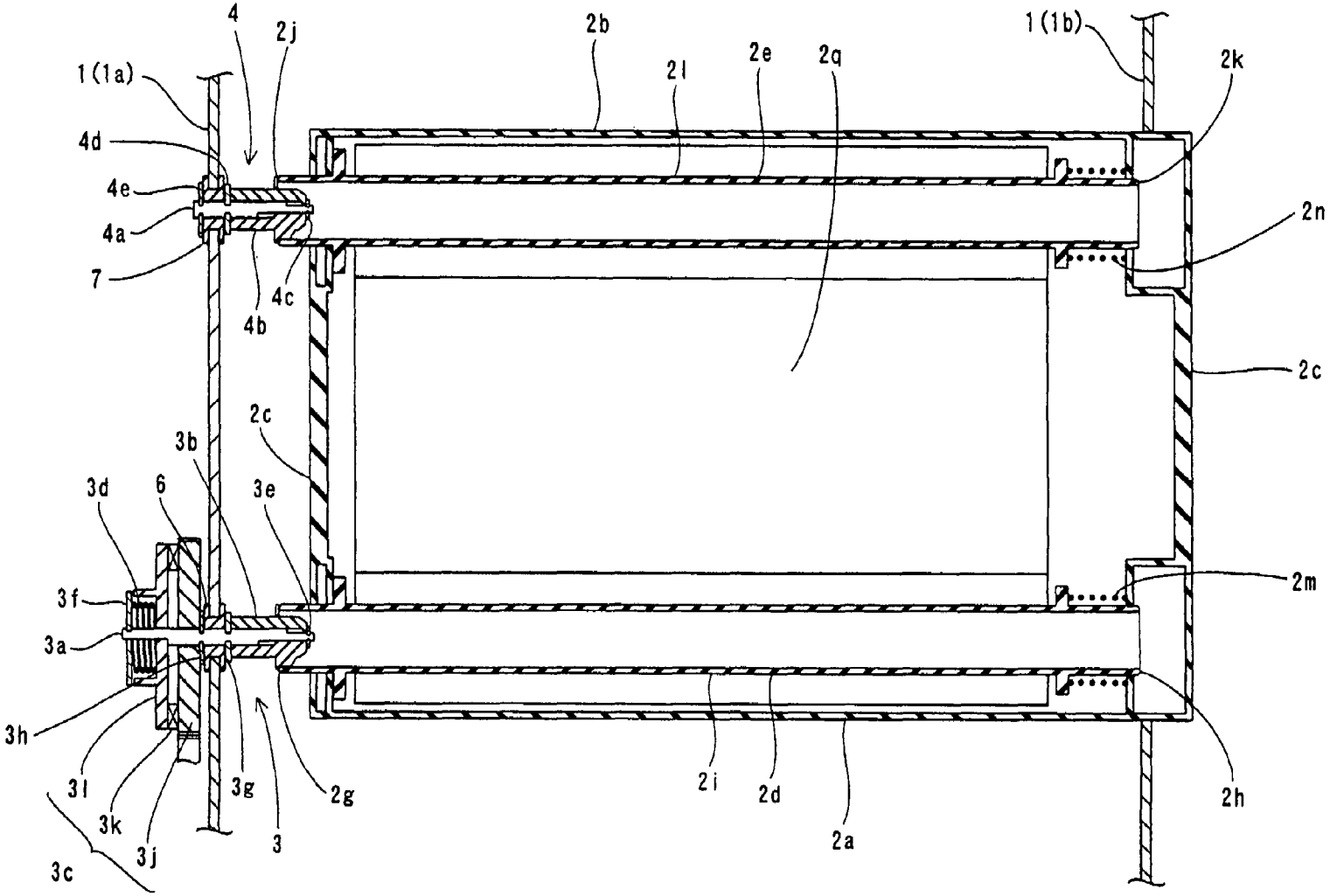
FIG. 9 is a cross sectional view of the thermal transfer printer pertaining to the embodiment shown in FIG. 1 as viewed from above at the section VII-VII shown in FIG. 2, after the ejection of the ink sheet cartridge.

Next, ejection of the ink sheet cartridge 2 is performed by first raising the grasping portion 5*d* of the latching member 5 shown in FIG. 3 upward against the biasing force of the leaf spring 5*c*. Accordingly, the engagement portion 5*a* of the latching member 5 is removed from the recess 2*f* of the linking portion 2*c* of the ink sheet cartridge 2. As a result, the compression coil springs 2*m* and 2*n* attached to the end portions 2*h* and 2*k* of the take-up bobbin 2*d* and the feed bobbin 2*e* try to return by their compressed ejection stroke L1. Accordingly, an ejection force is applied to the ink sheet cartridge 2 in the direction of the arrow O1. As a result, as shown in FIG. 9, the ink sheet cartridge 2 is moved in the eject direction by the ejection stroke amount L1 from the chassis 1.

With this embodiment, as discussed above, the take-up bobbin 2*d* and the feed bobbin 2*e* are biased in the direction toward the take-up reel 3 and the feed reel 4 (in the direction of the arrow N1 in FIG. 8) by the compression coil springs 2*m* and 2*n*, respectively, and the compression coil springs 2*m* and 2*n* that also generate such force for moving the ink sheet cartridge 2 by an ejection stroke amount (L1) in the eject direction are attached to the end portion 2*h* of the take-up bobbin 2*d* and the end portion 2*k* of the feed bobbin 2*e*. As a result, the take-up bobbin 2*d* and the feed bobbin 2*e* can be securely engaged with the take-up reel 3 and the feed reel 4, and the ink sheet cartridge 2 can be moved by an ejection stroke amount (L1) in the eject direction (in the direction of the arrow O1) with just the compression coil spring 2*m* attached to the take-up bobbin 2*d* and the compression coil spring 2*n* attached to the feed bobbin 2*e*. Therefore, there is no need to separately provide compression coil springs or other such spring members for obtaining an ejection stroke (L1) on the take-up reel 3 and feed reel 4 side. Thus, fewer parts are required.

Also, with this embodiment, when the ink sheet cartridge 2 has been installed in a thermal transfer printer main body, the end portion 2*g* the take-up bobbin 2*d* and the end portion 2*j* of the feed bobbin 2*e* are pressed and moved by the take-up reel 3 and the feed reel 4. Therefore, the compression coil springs 2*m* and 2*n* are compressed by the ejection stroke amount (L1). As a result, when the ink sheet cartridge 2 is to be ejected, the compression coil springs 2*m* and 2*n* try to return by their compressed ejection stroke amount (L1). Thus, the ink sheet cartridge 2 can be easily moved by the ejection stroke amount (L1).

Also, with this embodiment, the take-up bobbin 2*d* and the feed bobbin 2*e* are disposed within the ink sheet cartridge 2 so as to be movable by the ejection stroke amount (L1 in FIG. 7). Thus, the ink sheet cartridge 2 can be moved by the ejection stroke amount (L1 in FIG. 8) without moving the take-up reel 3 and the feed reel 4 in the eject direction (in the direction of the arrow O1 in FIG. 8).

Also, with this embodiment, since the latching member 5 is provided for securing the ink sheet cartridge 2 in its installed state. Thus, ejection of the ink sheet cartridge can be prevented even though the compression coil springs 2*m* and 2*n* attached to the end portions 2*h* and 2*k* of the take-up bobbin 2*d* and the feed bobbin 2*e* inside the ink sheet cartridge are pressed and compressed when the ink sheet cartridge 2 is installed.

The embodiments disclosed herein are no more than examples, and should not be construed as being limiting in nature. The scope of the present invention is given by the claims, and not by the above description of the embodiments, and furthermore the present invention encompasses all modifications that are within the equivalent meaning and scope as the claims.

For instance, in the above embodiments, a thermal transfer printer is used as an example of an image forming apparatus. However the present invention is not limited to such construction, and can also be applied to image forming apparatus other than a thermal transfer printer, as long as such image forming apparatus is equipped with an ink sheet cartridge.

Also, in the above embodiments, compression coil springs are used as an example of the present invention. However, the present invention is not limited to such construction, and leaf springs or other spring members may be used instead of compression coil springs.

Figure 10:
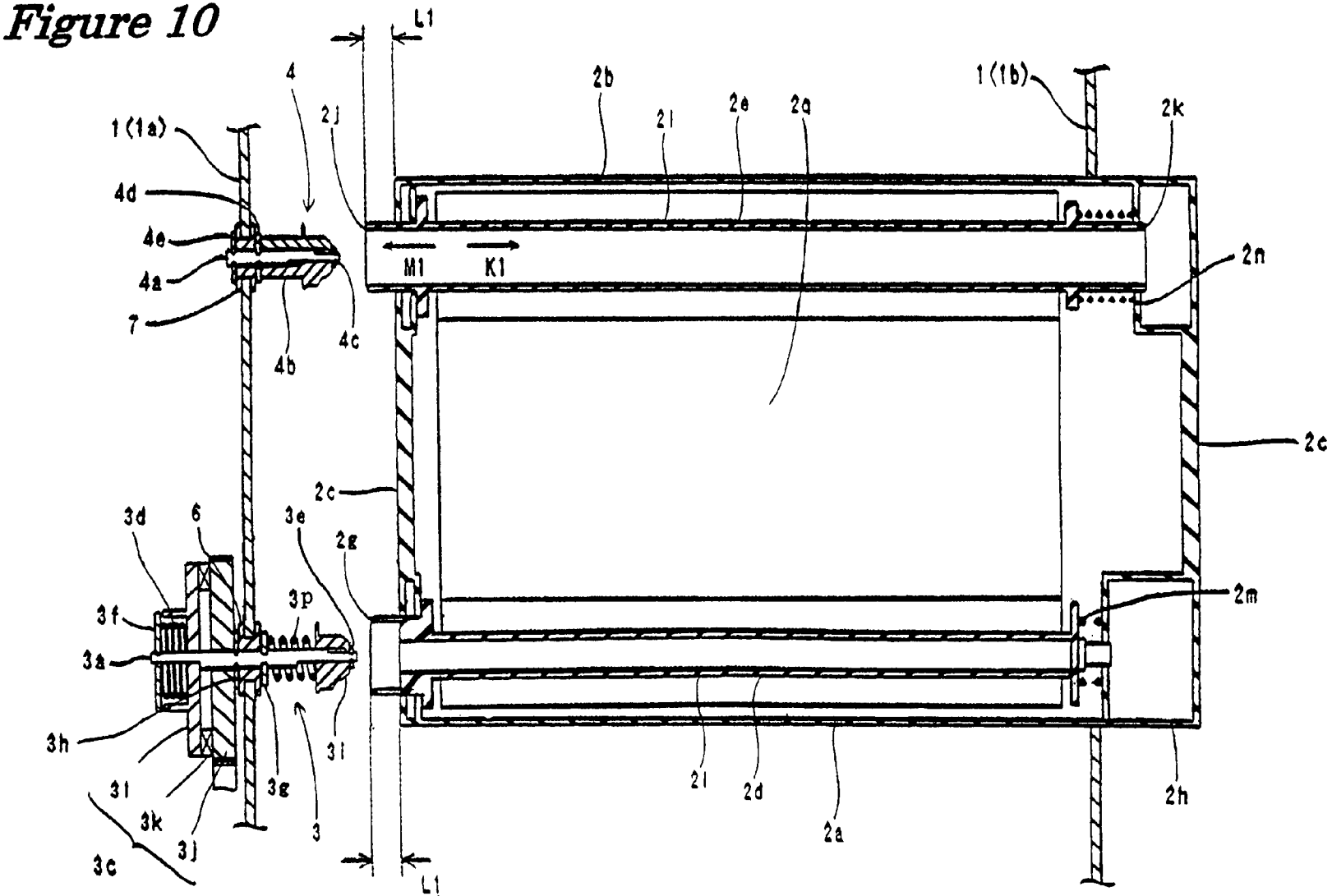
FIG. 10 is a cross sectional view of the thermal transfer printer pertaining to another embodiment as viewed from above at the section VII-VII shown in FIG. 2, before the installation of the ink sheet cartridge.
Figure 11:
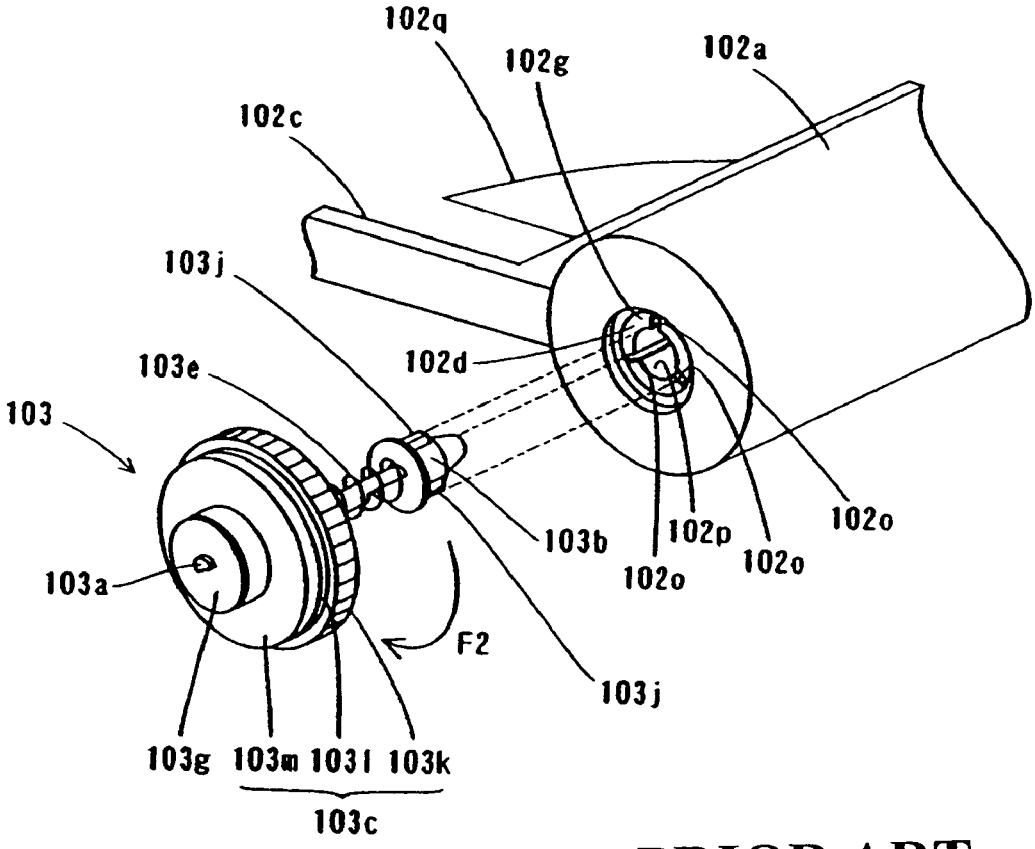
FIG. 11 is an exploded perspective view of the take-up reel and ink sheet cartridge of a conventional thermal transfer printer.
Figure 12:
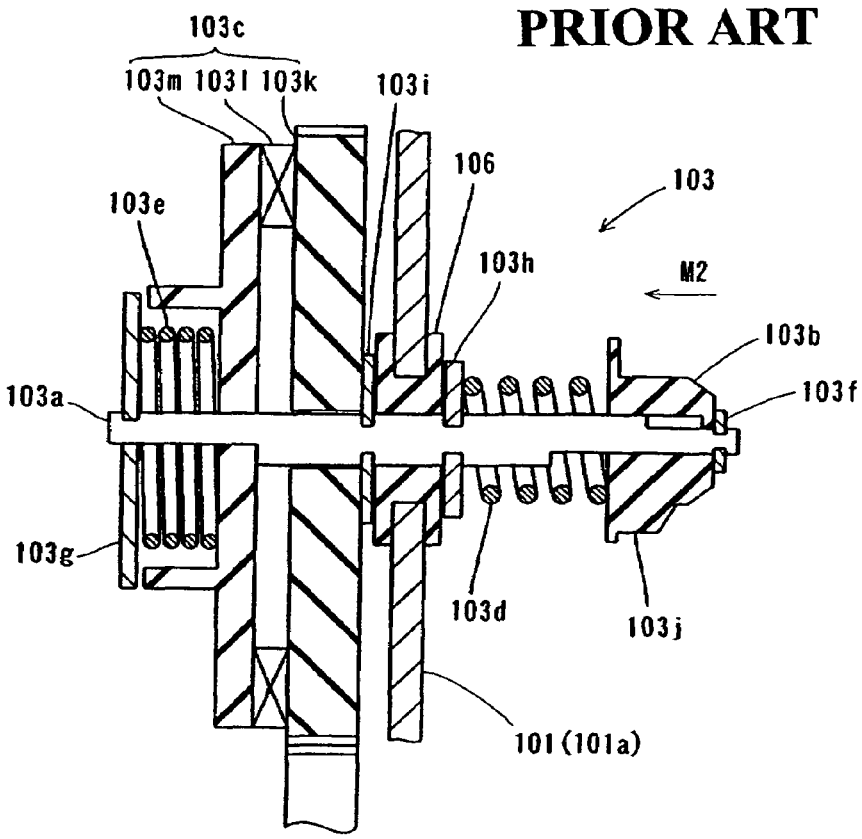
FIG. 12 is a partial cross sectional view of the take-up reel and ink sheet cartridge of the conventional thermal transfer printer.
Figure 13:
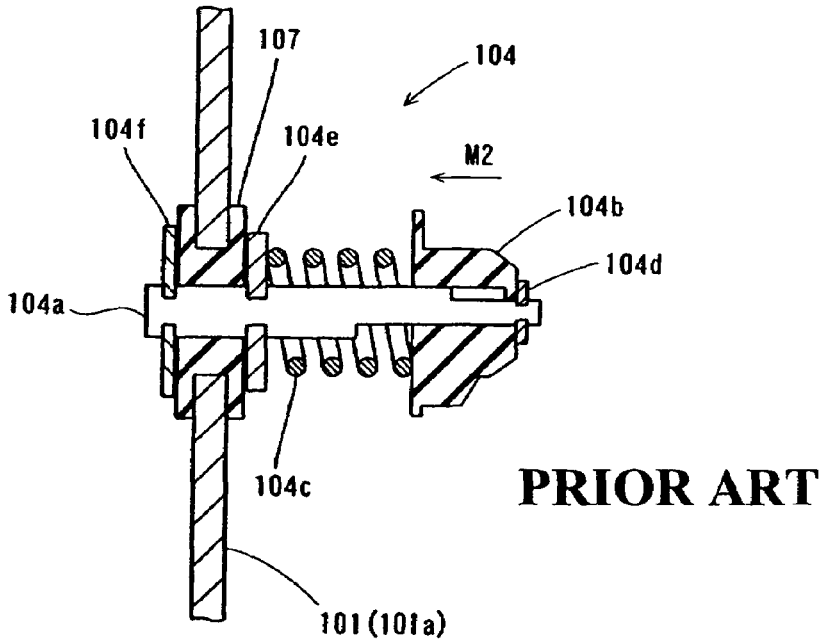
FIG. 13 is a partial cross sectional view of the feed reel and ink sheet cartridge of the conventional thermal transfer printer.
Figure 14:
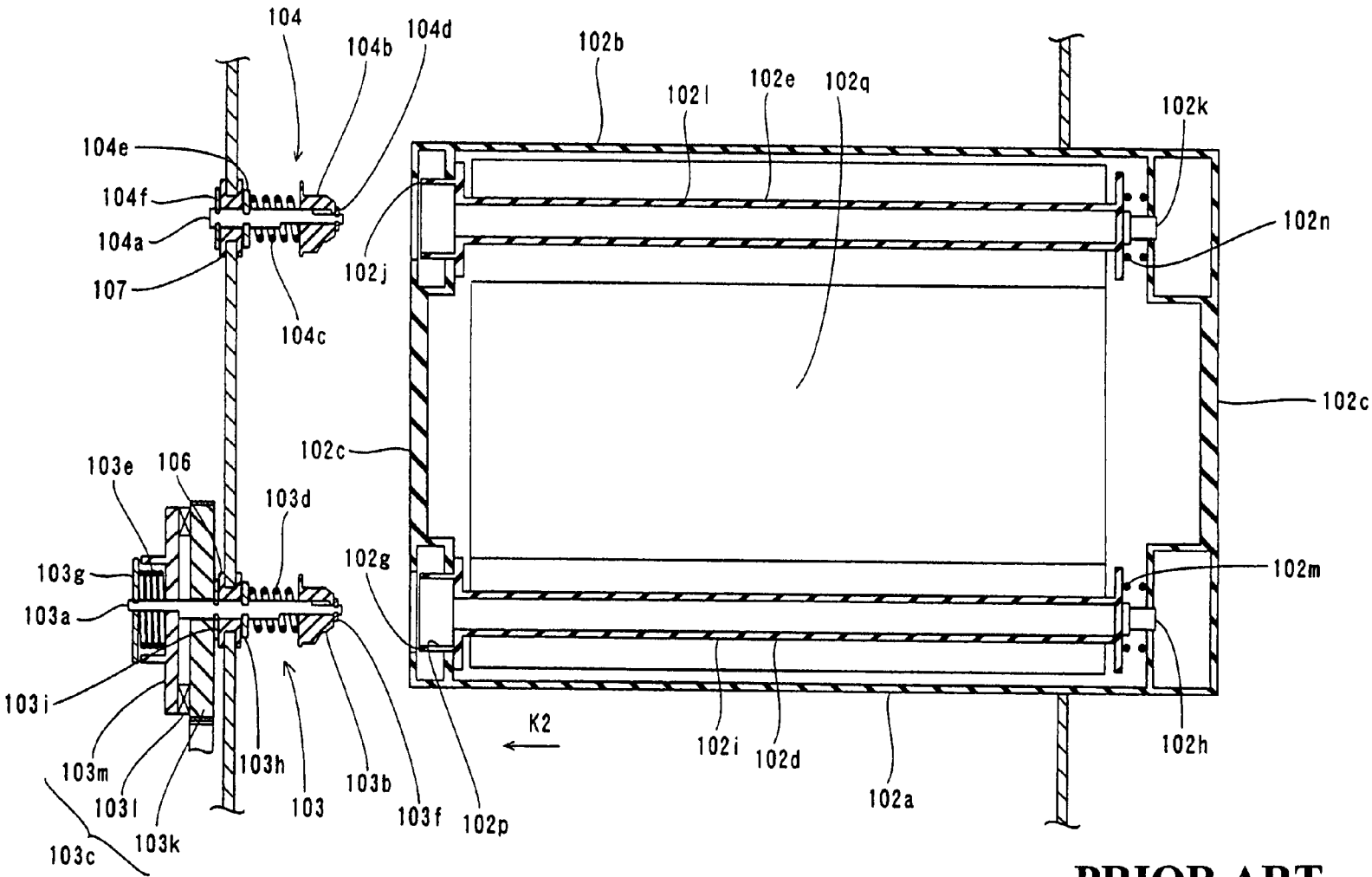
PRIOR ART Figure 14
FIG. 14 is a cross sectional view of the conventional thermal transfer printer before the installation of the ink sheet cartridge.
Figure 15:
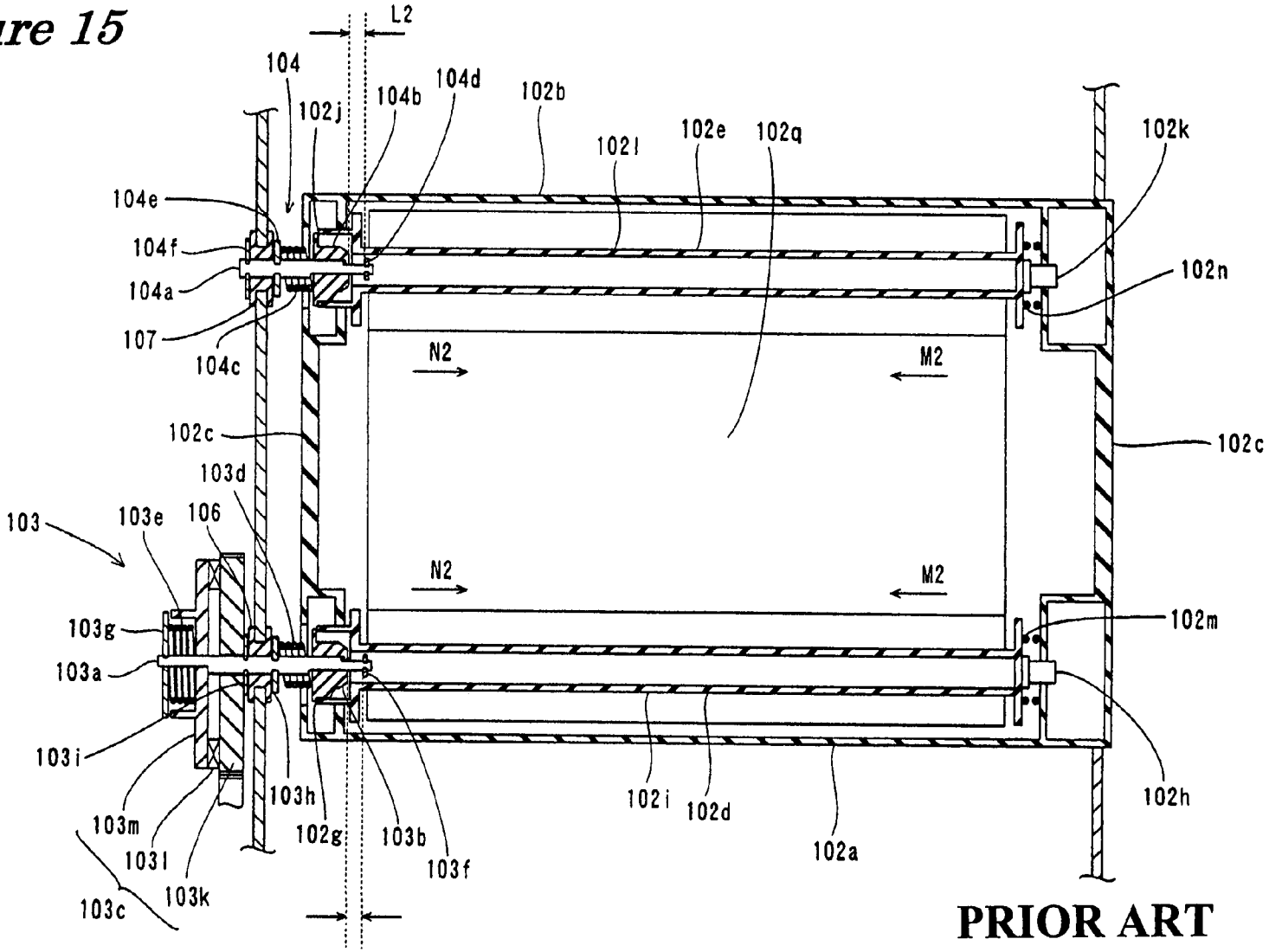
PRIOR ART Figure 15
FIG. 15 is a cross sectional view of the conventional thermal transfer printer after the installation of the ink sheet cartridge.
Figure 16:
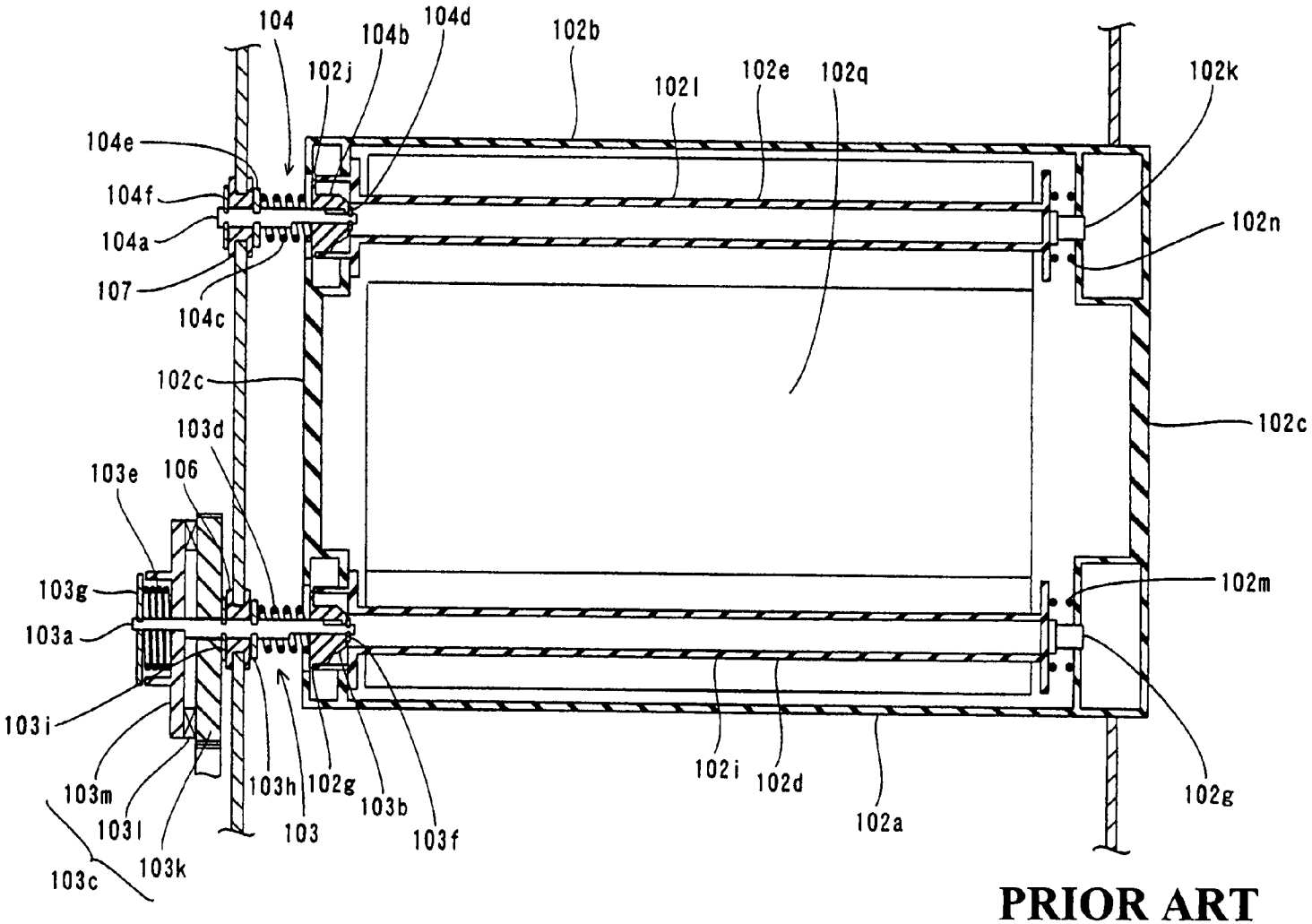
FIG. 16 is a cross sectional view of the conventional thermal transfer printer after the ejection of the ink sheet cartridge.

Furthermore, in the above embodiments, there are no compression coil springs between the feed bobbin engagement portion 4*b* and the position limiting snap ring 4*d* or between the take-up bobbin engagement portion 3*b* and the position limiting snap ring 3*g*. However, the present invention is not limited to such construction. There may be a compression coil spring disposed between one of between the feed bobbin engagement portion 4*b* and the position limiting snap ring 4*d* and between the take-up bobbin engagement portion 3*b* and the position limiting snap ring 3*g*. For example, FIG. 10 shows an example where a compression coil spring 3*p* is disposed between the take-up bobbin engagement portion 3*b* and the position limiting snap ring 3*g*.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a portion, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus, comprising:

a chassis having first and second side surfaces;

an ink sheet cartridge detachably disposed between the first and second side surfaces of the chassis, the ink sheet cartridge including a casing, a take-up bobbin disposed within the casing, a feed bobbin disposed within the casing, a film wound around the take-up bobbin and the feed bobbin, a first compression coil spring coupled to a circumference of a portion of the take-up bobbin so as to bias the take-up bobbin in a longitudinal direction of the ink sheet cartridge, and a second compression coil spring coupled to a circumference of a portion of the feed bobbin so as to bias the feed bobbin in the longitudinal direction;

a take-up reel rotatably supported by the first side surface of the chassis and including an engagement portion that engages the take-up bobbin when the ink sheet cartridge is installed in the chassis; and a feed reel rotatably supported by the first side surface of the chassis and including an engagement portion that engages the feed bobbin when the ink sheet cartridge is installed in the chassis, at least one of the take-up reel and the feed reel selectively engaging the corresponding one of the take-up bobbin and the feed bobbin without a biasing member being disposed between the first surface of the chassis and the corresponding one of the take-up bobbin and the feed bobbin, the casing of the ink sheet cartridge being moved in the longitudinal direction with respect to at least one of the engagement portions of the take-up reel and the feed reel by a predetermined amount that is equal to an ejection stroke between an installed position of the ink sheet cartridge and an ejected position of the ink sheet cartridge when the ink sheet cartridge is moved in the longitudinal direction between the installed position and the ejected position, at least one of the first and second compression coil springs of the ink sheet cartridge being compressed by the predetermined amount when the ink sheet cartridge is located at the installed position.

2. The image forming apparatus according to claim 1, wherein both of the take-up reel and the feed reel selectively engage the corresponding one of the take-up bobbin and the feed bobbin without a biasing member being disposed between the first surface of the chassis and the corresponding one of the take-up bobbin and the feed bobbin.

3. The image forming apparatus according to claim 1, wherein the take-up reel selectively engage the take-up bobbin with a third compression coil spring being disposed between the first surface of the chassis and the take-up bobbin, the third compression coil spring being coupled to a circumference of a portion of the take-up reel, and the feed reel selectively engage the feed bobbin without a biasing member being disposed between the first surface of the chassis and the feed bobbin.

4. The image forming apparatus according to any of claim 1, further comprising a latching member attached to the second surface of the chassis and selectively engaging the ink sheet cartridge for fixedly installing the ink sheet cartridge between the first and second surfaces of the chassis.

5. The image forming apparatus according to any of claim 1, further comprising the take-up bobbin is a one-piece unitary member, the first compression coil being coupled to a circumference of an end portion of the take-up bobbin, and the feed bobbin is a one-piece unitary member, the second compression coil being coupled to a circumference of an end portion of the feed bobbin.

6. An image forming apparatus, comprising:

a chassis having first and second side surfaces;

an ink sheet cartridge detachably disposed between the first and second side surfaces of the chassis, the ink sheet cartridge including a casing, a take-up bobbin which is a one-piece unitary member disposed within the casing, a feed bobbin which is a one-piece unitary member disposed within the casing, a film wound around the take-up bobbin and the feed bobbin, a first compression coil spring coupled to a circumference of an end portion of the take-up bobbin so as to bias the take-up bobbin in a longitudinal direction of the ink sheet cartridge, and a second compression coil spring coupled to a circumference of an end portion of the feed bobbin so as to bias the feed bobbin in the longitudinal direction;

a take-up reel rotatably supported by the first side surface of the chassis and including an engagement portion that engages the take-up bobbin when the ink sheet cartridge is installed in the chassis;

a feed reel rotatably supported by the first side surface of the chassis and including an engagement portion that engages the feed bobbin when the ink sheet cartridge is installed in the chassis; and a latching member attached to the second surface of the chassis and selectively engaging the ink sheet cartridge for fixedly installing the ink sheet cartridge between the first and second surfaces, both of the take-up reel and the feed reel selectively engaging the corresponding one of the take-up bobbin and the feed bobbin without a biasing member being disposed between the first surface of the chassis and the corresponding one of the take-up bobbin and the feed bobbin, the casing of the ink sheet cartridge being moved in the longitudinal direction with respect to the engagement portions of the take-up reel and the feed reel by a predetermined amount that is equal to an ejection stroke between an installed position of the ink sheet cartridge and an ejected position of the ink sheet cartridge when the ink sheet cartridge is moved in the longitudinal direction between the installed position and the ejected position, the first and second compression coil springs of the ink sheet cartridge being compressed by the predetermined amount, respectively, when the ink sheet cartridge is located at the installed position.

* * * * *